US011813855B2

(12) United States Patent
Chang

(10) Patent No.: US 11,813,855 B2
(45) Date of Patent: Nov. 14, 2023

(54) BARCODE PRINTER

(71) Applicant: Top Vending Machine Electronics Co., Ltd., Taoyuan (TW)

(72) Inventor: Yuan-Fong Chang, Taoyuan (TW)

(73) Assignee: Top Vending Machine Electronics Co., Ltd., Taoyuan (TW)

( * ) Notice: Subject to any disclaimer, the term of this patent is extended or adjusted under 35 U.S.C. 154(b) by 173 days.

(21) Appl. No.: 17/541,525

(22) Filed: Dec. 3, 2021

(65) Prior Publication Data

US 2023/0173828 A1 Jun. 8, 2023

(51) Int. Cl.
*B41J 11/70* (2006.01)
*B41J 3/01* (2006.01)

(52) U.S. Cl.
CPC ..... *B41J 11/70* (2013.01); *B41J 3/01* (2013.01)

(58) Field of Classification Search
CPC . B41J 11/70; B41J 3/01; B41J 11/0095; B41J 11/46; B41J 15/042; B41J 2/01
See application file for complete search history.

(56) References Cited

U.S. PATENT DOCUMENTS

2009/0174139 A1* 7/2009 Chen ..... B41J 3/4075 271/278
2014/0060275 A1* 3/2014 Chng ..... B26D 1/385 83/165
2019/0001712 A1* 1/2019 Nohara ..... B41J 11/70

* cited by examiner

*Primary Examiner* — Kristal Feggins

(57) ABSTRACT

A barcode printer includes a frame on which a paper receiving device, a printing device, a cutting device, and a paper output device are disposed. The paper receiving device receives a plurality of printing papers which is interconnected and folded in a zigzag manner. A front edge of the uppermost printing paper is inserted downward into a paper inlet passage of the printing device. A paper delivering motor moves the uppermost printing paper forward to pass through a gap between a printer and a paper delivering roller. A printer is activated to print a barcode on a lower face of the uppermost printing paper. The front edge of the uppermost printing paper is moved to pass through the cutter and the paper output roller unit. The paper delivering motor is then stopped, and a rear edge of the uppermost printing paper is cut under operation of a paper output motor.

10 Claims, 19 Drawing Sheets

BARCODE PRINTER

BACKGROUND OF THE INVENTION

The present invention relates to the printer technology and, more particularly, to a barcode printer.

Currently available barcode printers for business generally use a plurality of interconnected printing papers folded in a zigzag. A paper delivering roller moves a printing paper forward to pass through a printer which is activated to print a one-dimensional barcode on a face of the printing paper. After the printing paper printed with the barcode moves forward and passes through a paper cutting device and a paper output device, the paper cutting device cuts a rear edge of the printed paper originally connected to a front edge of the next printing paper, and paper output rollers moves the printed paper forward and outward.

However, the paper tray of the conventional barcode printer cannot be adjusted in response to the length of the stacked height of the printing papers. Furthermore, the printing paper tends to tilt and wobble while entering the printing device, adversely affecting actuation of printing controlled by detection. Furthermore, troubleshooting should be carried out conveniently when the printing paper is jammed while moving in the printing device and the paper output device. Thus, a need exists for a novel barcode printer that mitigates and/or obviates the above drawbacks.

BRIEF SUMMARY OF THE INVENTION

An objective of the present invention is to provide a barcode printer that can be adjusted in response to the length of the stacked height of the printing papers and that can control the printing paper to be stably fed, printed, cut, and outputted while permitting easy removal of the jammed printing paper.

To achieve the above objective, a barcode printer according to the present invention comprises a frame, a paper receiving device, a printing device, a cutting device, and a paper output device, with the paper receiving device, the printing device, the cutting device, and the paper output device disposed on the frame, wherein the paper receiving device includes a receiving space having an upwardly facing opening, wherein the receiving space is configured to receive a plurality of printing papers which is interconnected and folded in a zigzag manner, wherein each of the plurality of printing papers has a mark on a face thereof, wherein the printing device includes a printing seat, a printer, a paper delivering roller, a pivotal holding member, a paper feeding motor, and a first detector, wherein the printing seat includes a top portion having a paper inlet passage extending in a transverse direction, wherein a front arcuate guiding board and a rear guiding board extend upward from a front side and a rear side of the paper inlet passage, respectively, wherein the printer is disposed in the printing seat and extends in a transverse direction, wherein the paper delivering roller presses against the printer and has two shaft ends rotatably mounted to two holding arms on two sides of the pivotal holding member, wherein the paper feeding motor is located below the printer and is configured to drive the paper delivering roller via a gear unit, wherein the paper cutting device includes a paper cutting seat and a cutter disposed in the paper cutting seat, wherein the cutter has a cutting blade facing downwards, wherein the paper output device includes a paper output seat, a top cover, a paper output roller unit, a paper output motor, and a paper output connecting seat, wherein the paper output seat has a rear section extending below the cutter to a position adjacent to the printer, wherein the top cover is openably disposed on top of the paper output seat, wherein the paper output roller unit is disposed on a front section of the paper output seat and extends in the transverse direction, wherein the paper output roller unit includes two paper output rollers disposed in parallel and pressing against each other, wherein the paper output motor is configured to drive one of the two paper output rollers, wherein the paper output connecting seat and a front end of the paper output seat together form a paper outlet, wherein a front edge of an uppermost one of the plurality of printing papers is inserted downward in between the front arcuate guiding board and the rear guiding board of the printing seat, the uppermost one of the plurality of printing papers enters the paper inlet passage, wherein the paper delivering motor drives the paper delivering roller to move the uppermost one of the plurality of the printing papers forward to pass through a gap between the printer and the paper delivering roller, wherein when the mark on the uppermost one of the plurality of the printing papers is detected by the first detector, the printer is activated to print a barcode on a lower face of the uppermost one of the plurality of the printing papers, the front edge of the uppermost one of the plurality of the printing papers is moved to pass through the cutter, the paper output seat, and a gap between the two paper output rollers, wherein the paper delivering motor is then stopped to stop a rear edge of the uppermost one of the plurality of the printing papers at a position below the cutter, wherein the paper output motor drives the paper output roller unit to pull the plurality of the printing papers forward, moving the rear edge of the uppermost one of the plurality of the printing papers upward to contact with the cutting blade to cut the rear edge, and wherein the paper output roller unit moves the cut printing paper forward and outward.

In an example, the paper receiving device further includes a partitioning board detachably mounted in the receiving space and configured to match with a length of associated printing papers to be received in the receiving space.

In an example, a substantially U-shaped fender associated with the receiving space is disposed upright on a peripheral edge of a top portion of the paper receiving device and has a forwardly facing opening. A sensor is disposed in the receiving space and is configured for detecting whether the plurality of printing papers reaches a low inventory level.

In an example, the front arcuate guiding board is higher than the rear guiding board and has two stop boards at two sides thereof.

In an example, the two holding arms on the two sides of the pivotal holding member of the printing device are pivotably mounted to the printing seat. A plurality of springs is connected between the pivotal holding member and the printer, such that the two holding arms are biased downwardly to be securely coupled to the two shaft ends of the paper delivering roller. One of the two holding arms has a pressing portion configured to be manually pressed to pivot the two holding arms upward to release the paper delivering roller. The printing seat includes a stopper configured to be pivotable to a position stopping the pressing portion of the one of the two holding arms.

In an example, each of the printing seat and the paper cutting seat includes an intermediate portion having a recess facing the paper delivering roller.

In an example, a micro switch is disposed on the paper output seat and is configured to detect an open state or a closed state of the top cover.

In an example, a second detector is disposed in the paper output seat and is configured to detect output of the cut printing paper.

In an example, a fixing seat is movably connected to a bottom portion of the frame. The fixing seat includes two guiding tracks on two sides thereof. The bottom portion of the frame includes two side tracks associated with the two guiding tracks. A third detector is disposed on the frame and is configured to detect forward displacement of the frame relative the fixing seat.

In an example, a positioning member is disposed on the bottom portion of the frame. The positioning member includes two elastic positioning portions extending on two sides thereof. Each of the two guiding tracks of the fixing seat has two positioning grooves on a front portion and a rear portion thereof, respectively.

The present invention will become clearer in light of the following detailed description of illustrative embodiments of this invention described in connection with the drawings.

DETAILED DESCRIPTION OF THE INVENTION

Figure 1:
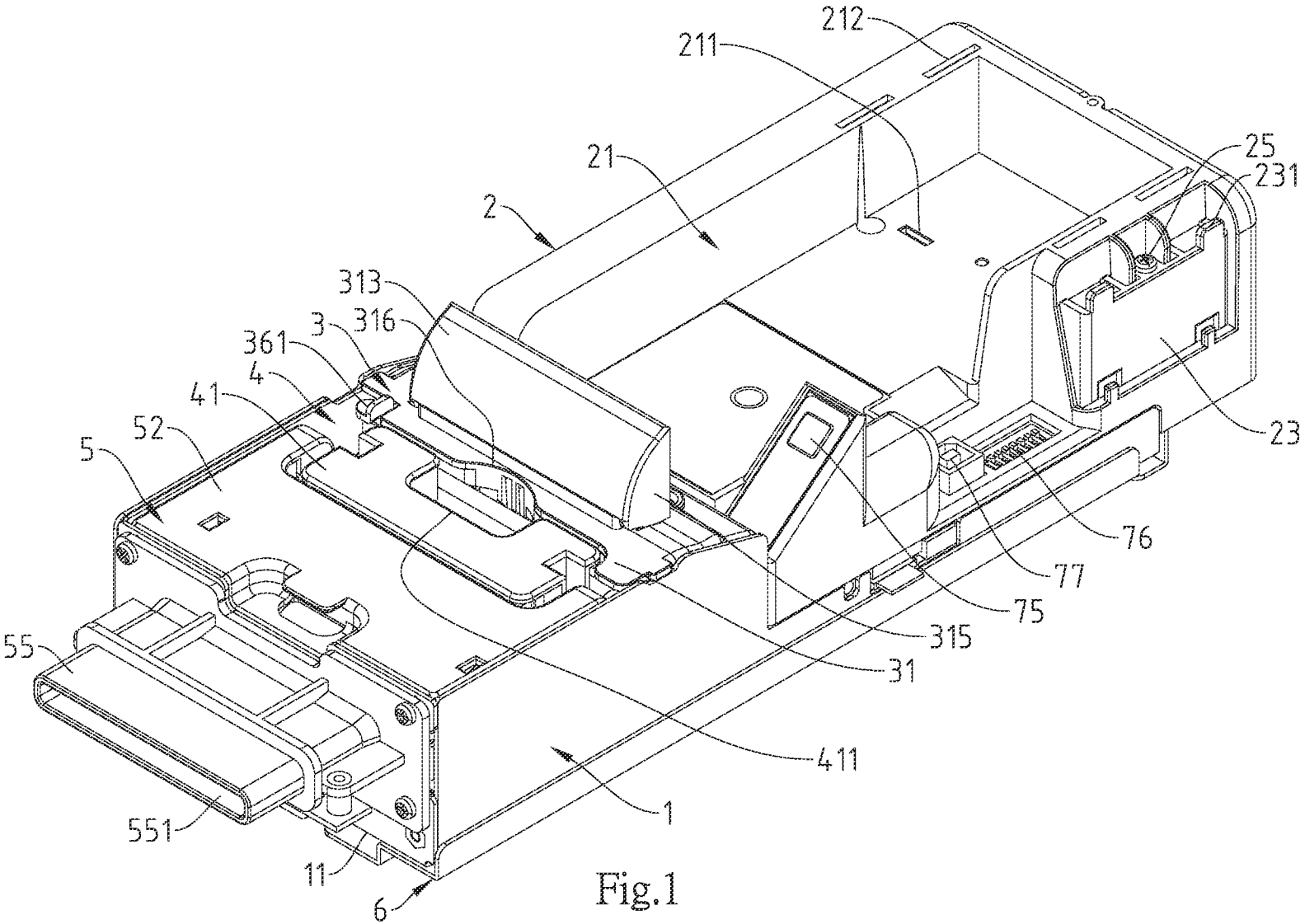
FIG. 1 is a front, top, right perspective view of a barcode printer of an embodiment according to the present invention.
Figure 2:
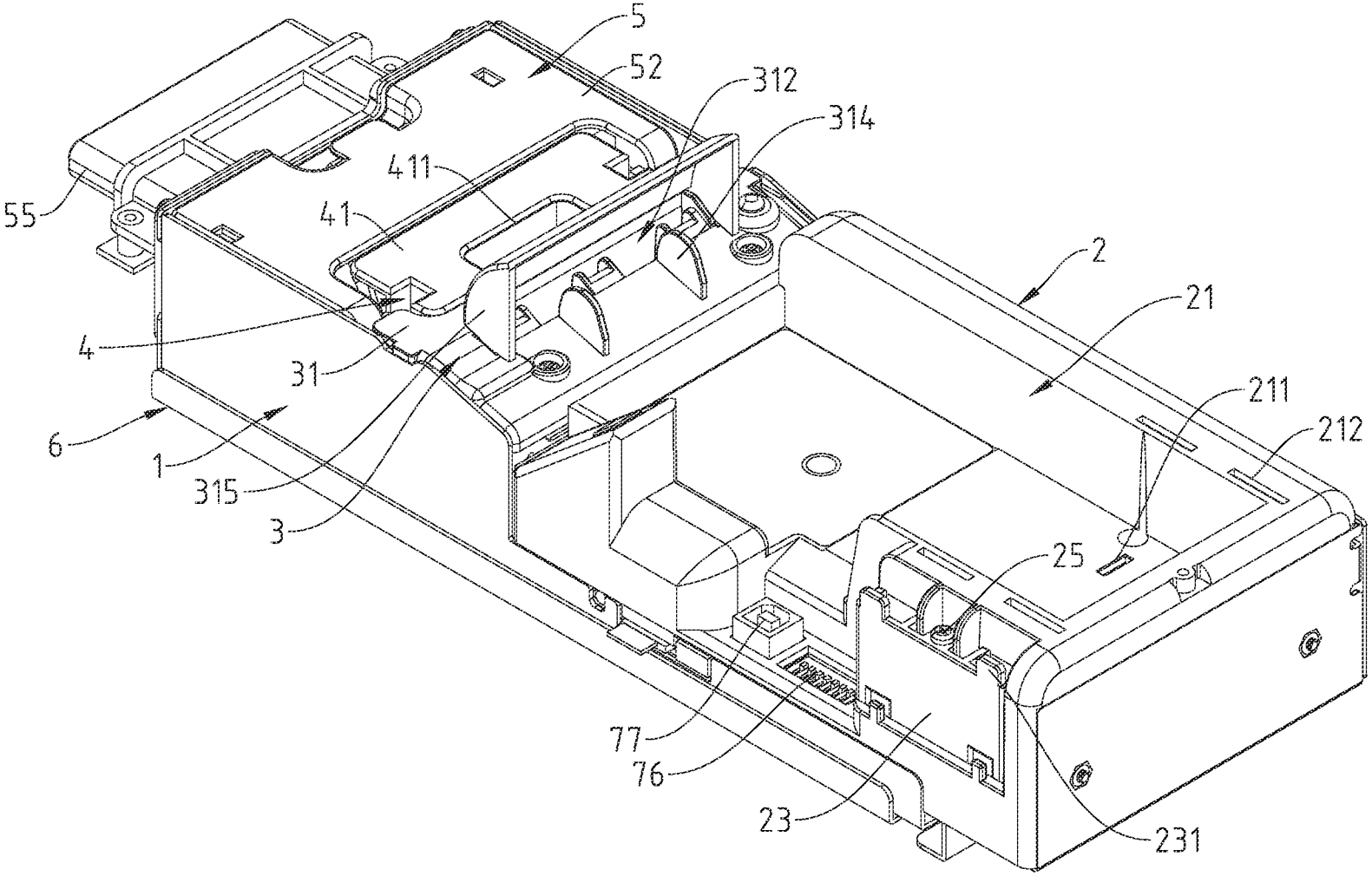
FIG. 2 is a rear, top perspective view of the barcode printer of the embodiment according to the present invention.
Figure 3:
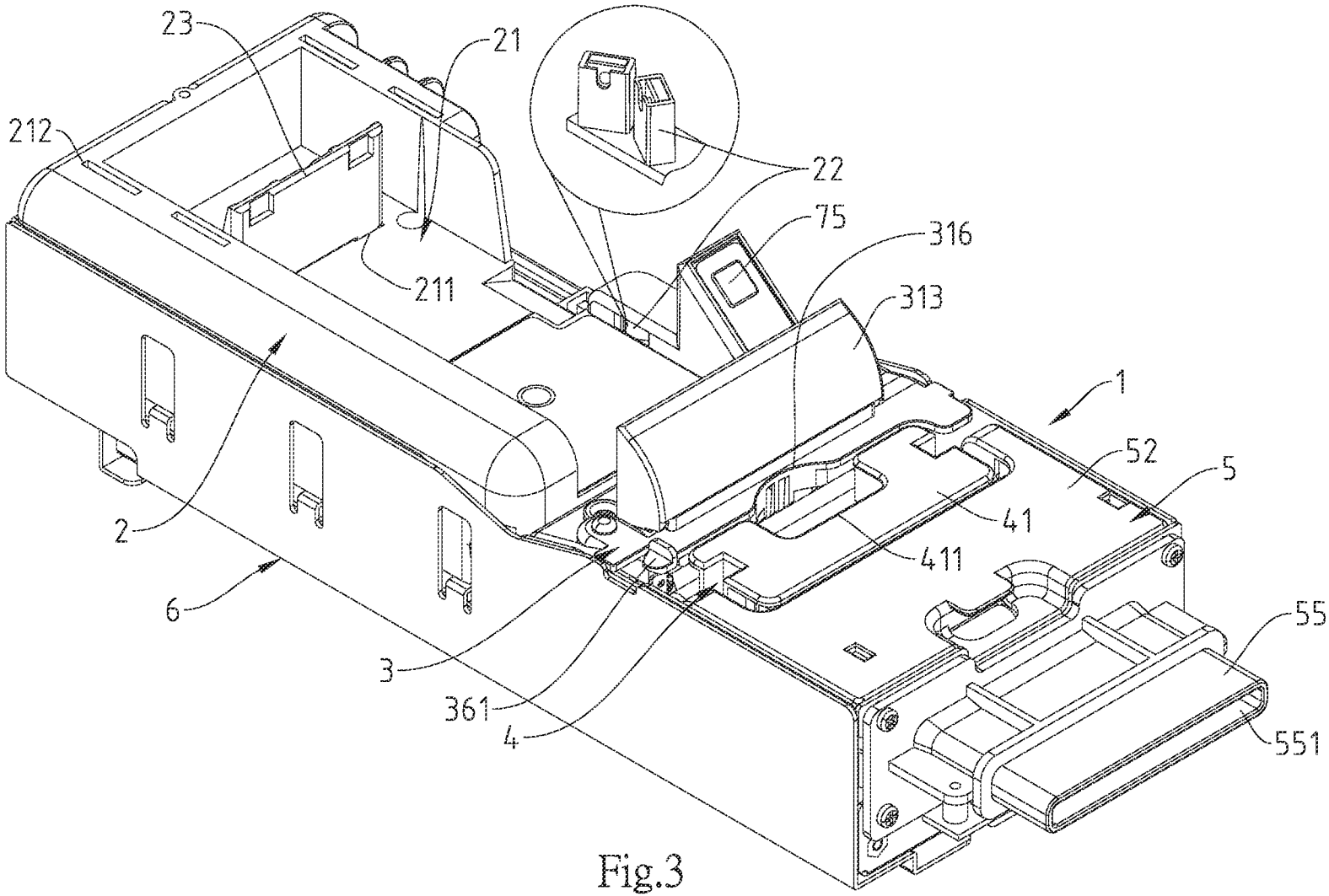
FIG. 3 is a front, top, left perspective view of the barcode printer of the embodiment according to the present invention with a partitioning board assembled to a paper receiving device.

With reference to FIGS. 1-13, a barcode printer of an embodiment according to the present invention is generally used to print one-dimensional barcodes and comprises a frame 1, a paper receiving device 2, a printing device 3, a cutting device 4, and a paper output device 5, with the paper receiving device 2, the printing device 3, the cutting device 4, and the paper output device 5 disposed, from rear to front in sequence, on the frame 1. Furthermore, a circuit module 7 is disposed to a bottom portion of the frame 1, and a fixing seat 6 is movably connected to an underside of the bottom portion of the frame 1.

The frame 1 includes a seat 11 having an upwardly facing opening. Two side tracks 12 and a positioning member 13 are disposed on the bottom portion of the frame 1 (see FIGS. 5 and 8). The positioning member 13 includes two elastic positioning portions 131 extending on two sides thereof.

Figure 14:
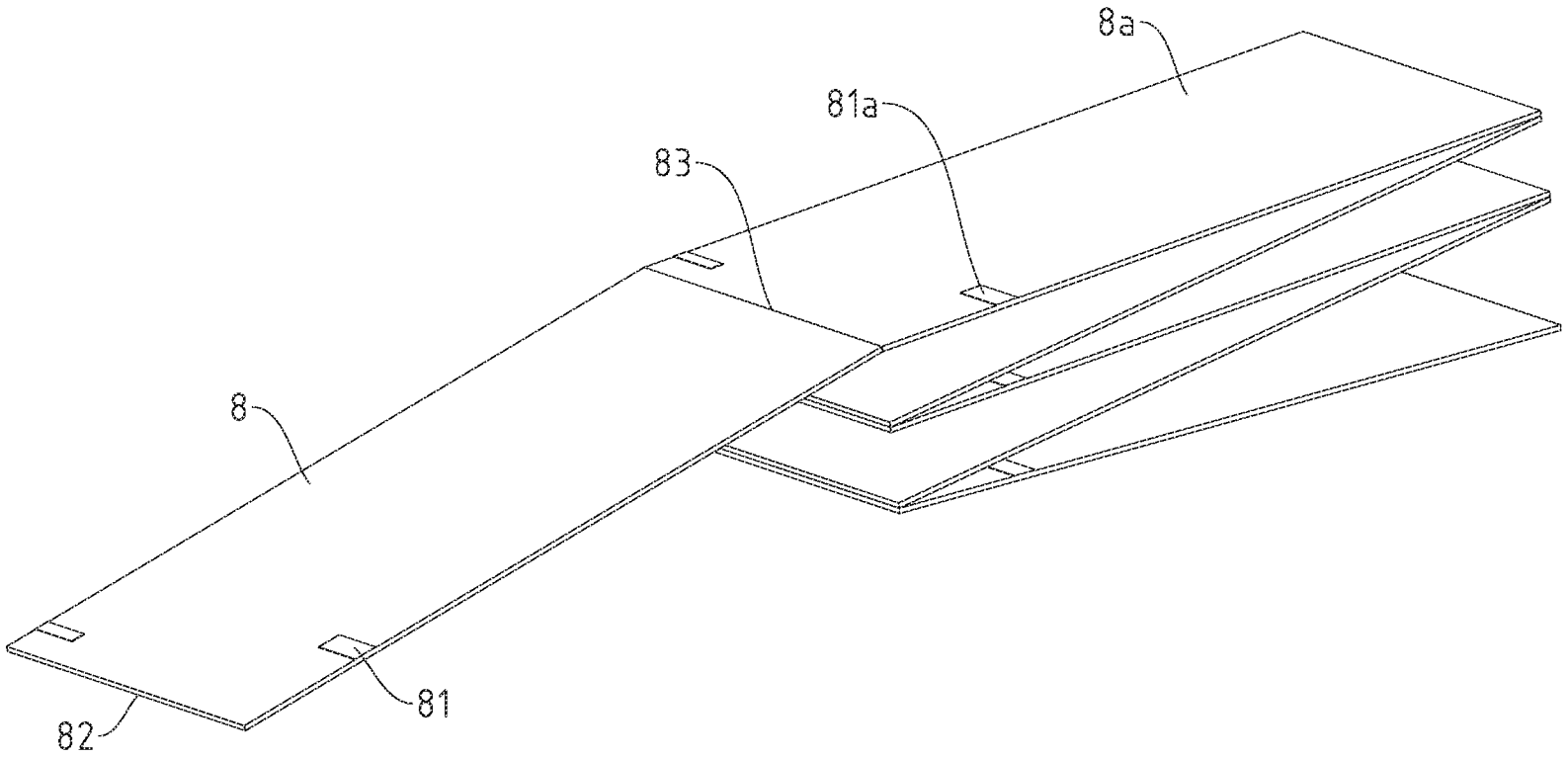
FIG. 14 is a perspective view illustrating a plurality of printing papers used with the barcode printer of the embodiment according to the present invention.

The paper receiving space 2 includes a receiving space having an upwardly facing opening. The receiving space 21 is configured to receive a plurality of printing papers 8 (see FIGS. 5 and 14) interconnected and folded in a zigzag manner. Each of the plurality of printing papers 8 has a mark 81 on a face thereof, with the mark 81 located adjacent to a front edge 82 and distant to a rear edge 83 of the respective printing paper 8. The paper receiving device 2 further includes a partitioning board 23 (see FIG. 3) detachably mounted in the receiving space 21. An insertion block 231 of the partitioning board 23 is inserted into a slot 211 to match with printing papers (not shown) of a shorter length. When in a storage position (see FIGS. 1 and 2), the partitioning board 23 is secured to an outer side of the paper receiving device 2.

Figure 4:
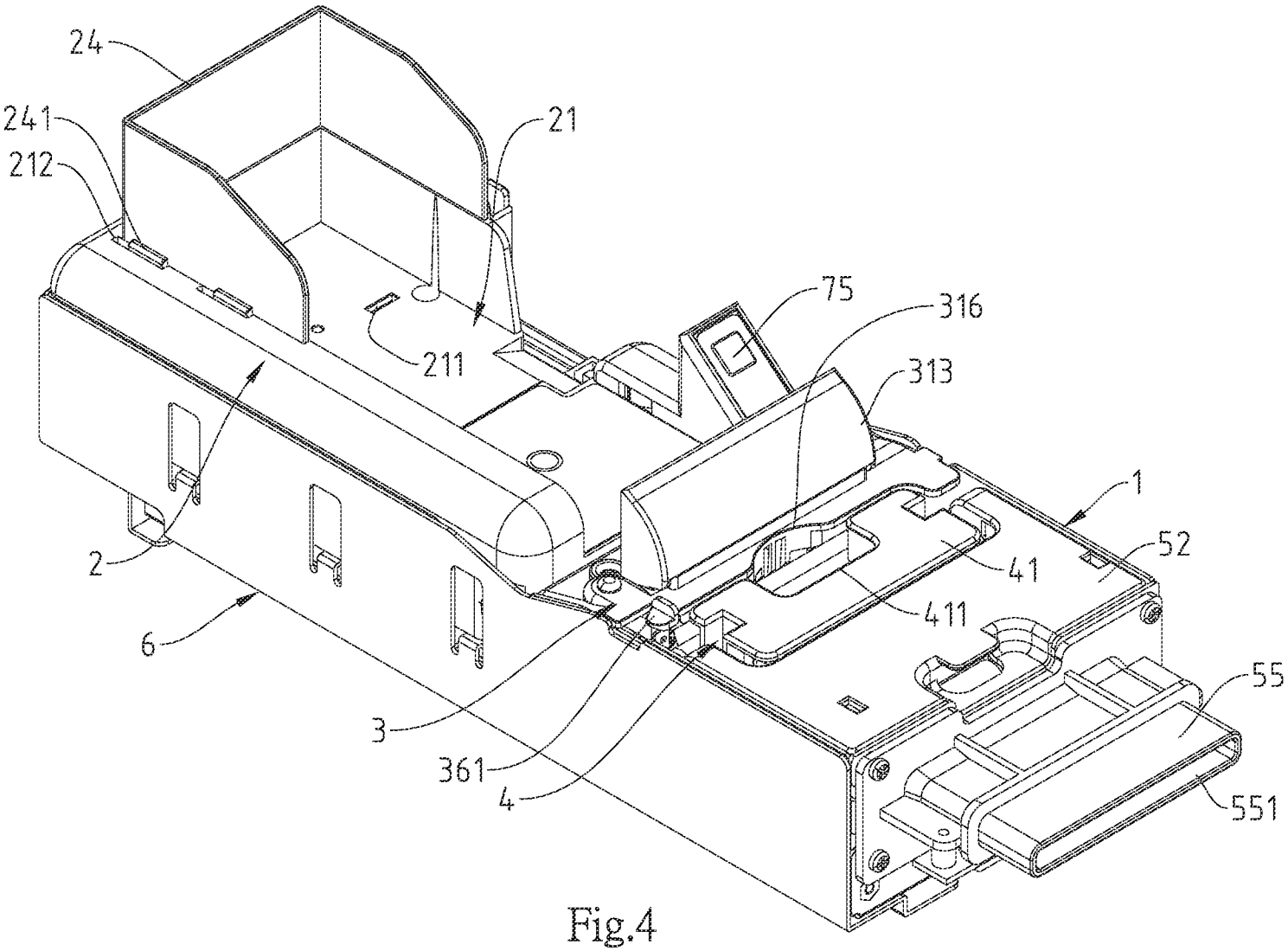
FIG. 4 is a front, top, left perspective view of the barcode printer of the embodiment according to the present invention with a fender assembled to the paper receiving device.

A substantially U-shaped fender 24 associated with the receiving space 21 is disposed upright on a peripheral edge of a top portion of the paper receiving device 2 and has a forwardly facing opening (see FIG. 4). Insertion blocks 241 of the fender 24 are inserted into slots 212 to increase the stackable height of the plurality of printing papers 8. A sensor 22 (see FIG. 3) is disposed in the receiving space 21 and is configured for detecting whether the printing papers 8 reach a low inventory level.

The printing device 3 includes a printing seat 31, a printer 32, a paper delivering roller 33, a pivotal holding member 34, a paper delivering motor 35, and a first detector 37. The printing seat 31 includes a top portion having a paper inlet passage 312 (see FIGS. 2 and 5) extending in a transverse direction. Furthermore, a front arcuate guiding board 313 and a rear guiding board 314 extend upward from a front side and a rear side of the paper inlet passage 312, respectively. The front arcuate guiding board 313 is higher than the rear guiding board 314. Furthermore, the front arcuate guiding board 313 has two stop boards 315 at two sides thereof to stably guide the printing papers 8, avoiding the uppermost printing paper 8 from forward tilting and wobbling which could cause erroneous sensing.

Figure 5:
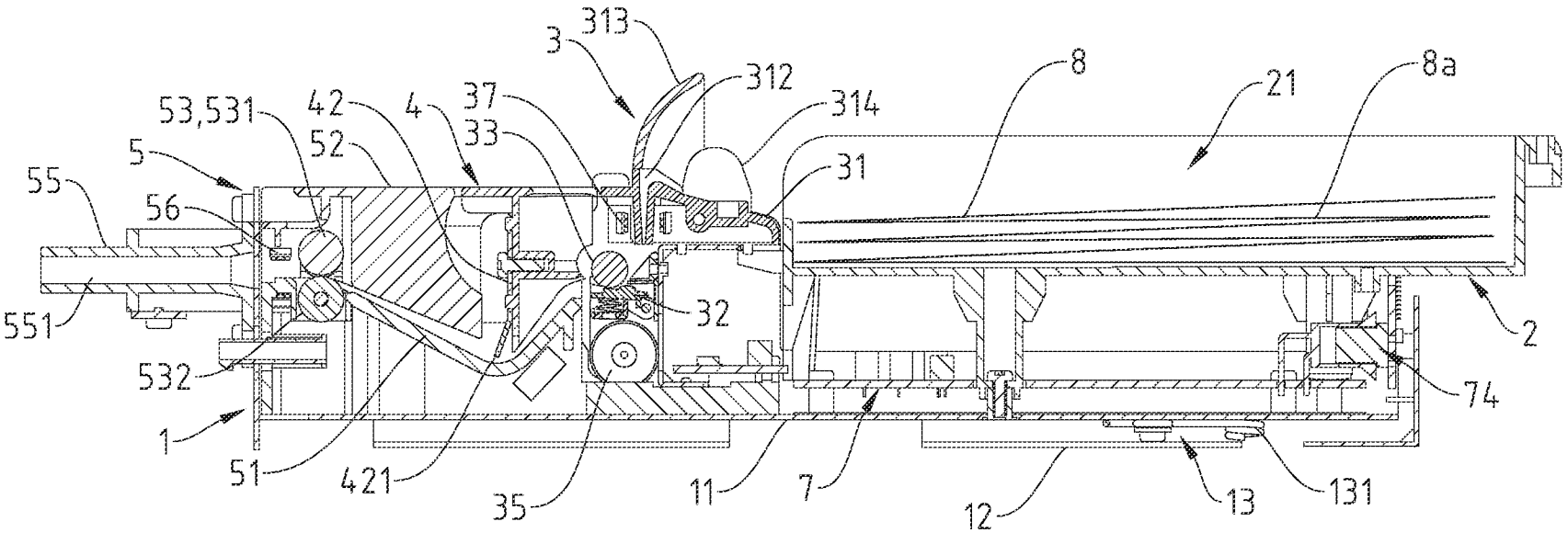
FIG. 5 is a cross sectional view of the barcode printer of the embodiment according to the present invention.
Figure 9:
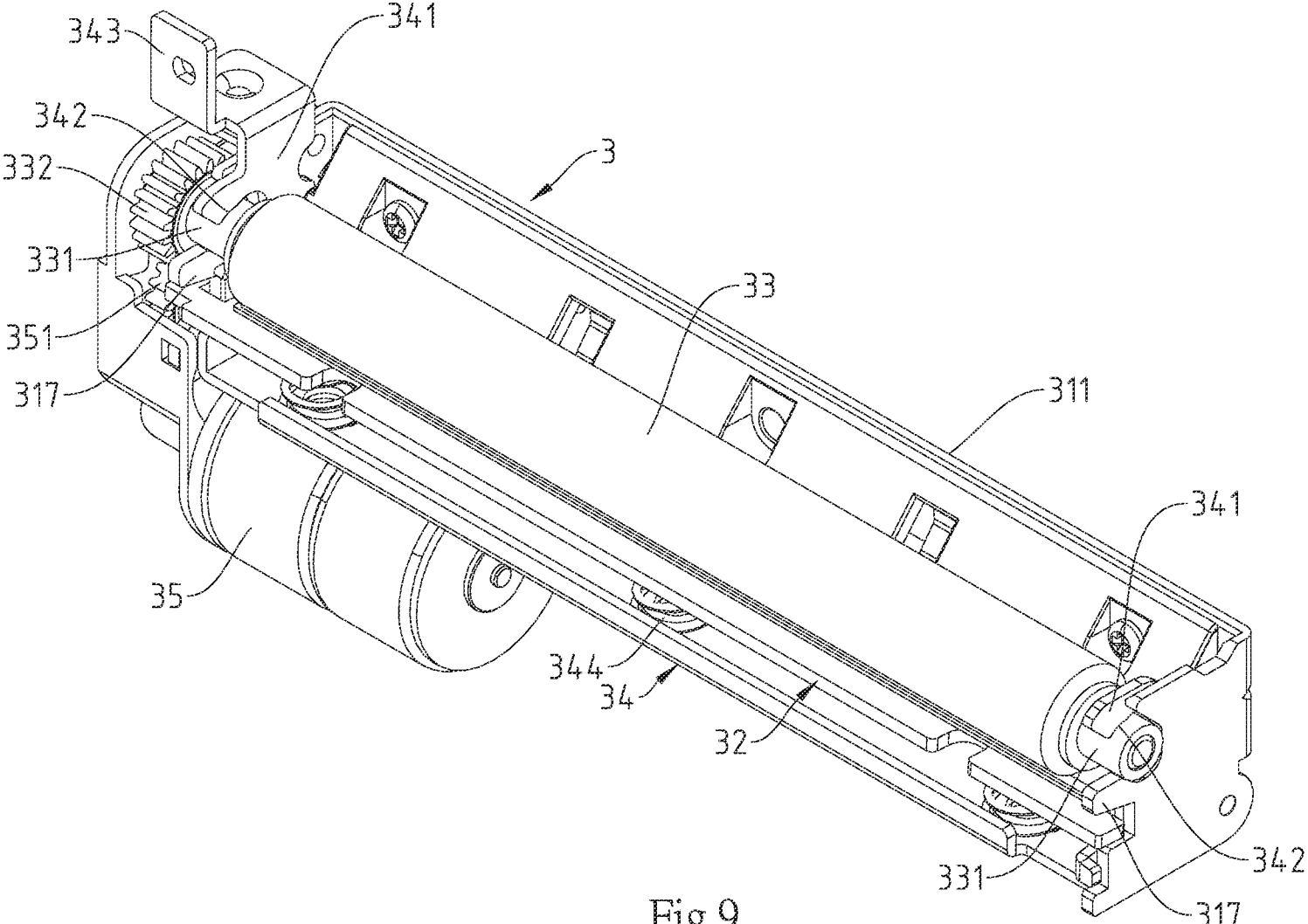
FIG. 9 is a perspective view illustrating an interior of a printing device of the barcode printer of the embodiment according to the present invention.
Figure 10:
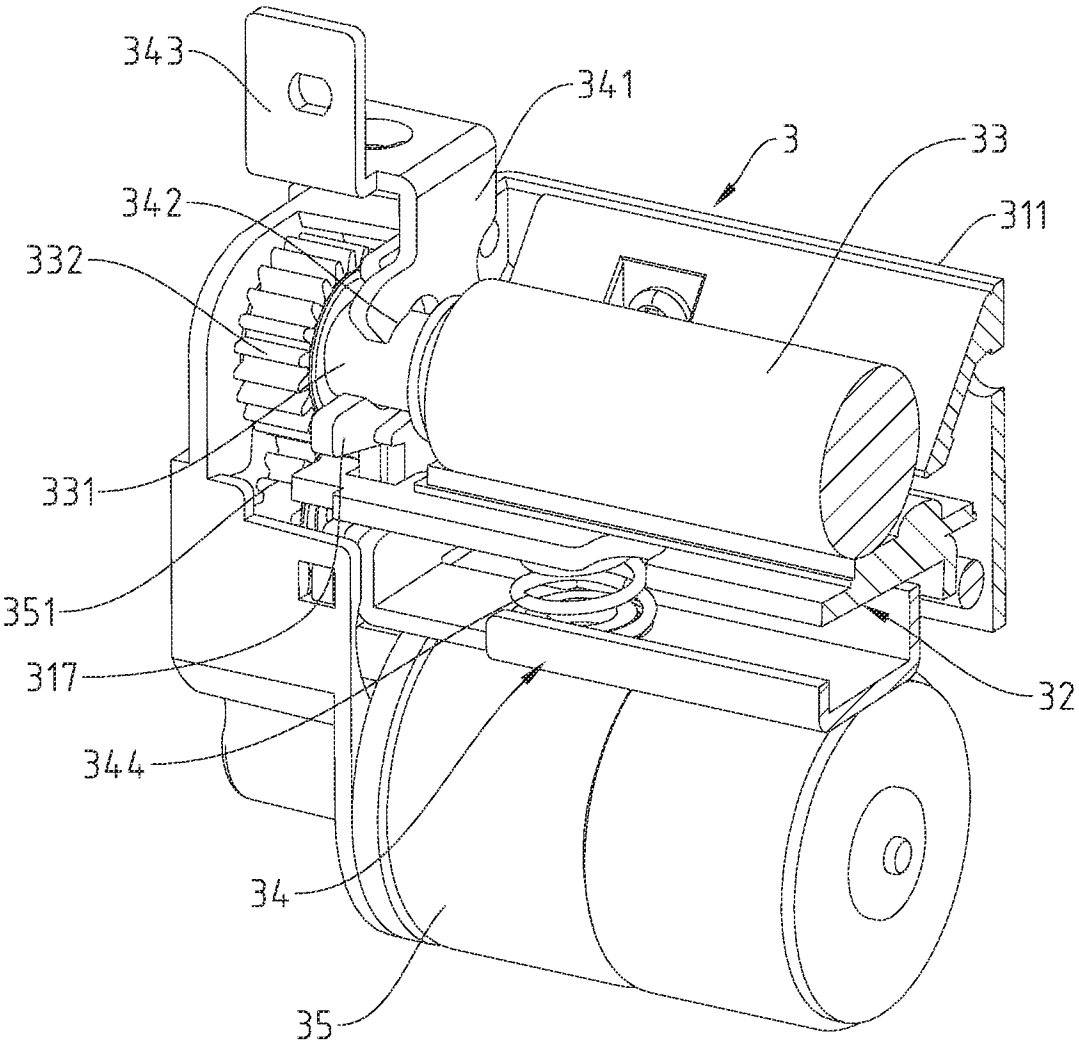
FIG. 10 is a partly-cutaway perspective view of the printing device of the barcode printer of the embodiment according to the present invention.
Figure 11:
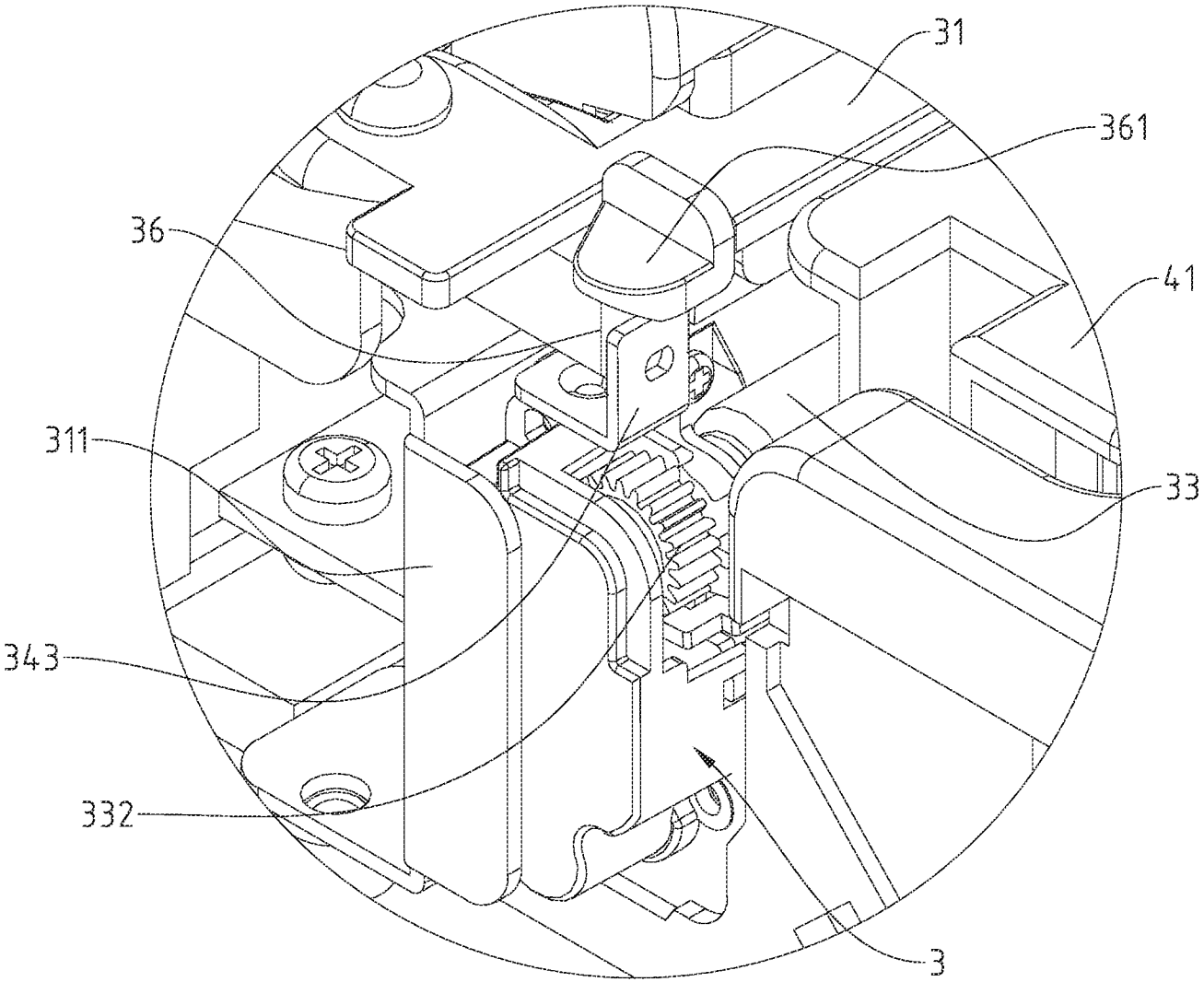
FIG. 11 is an enlarged view of a portion of the printing device of the barcode printer of the embodiment according to the present invention.
Figure 12:
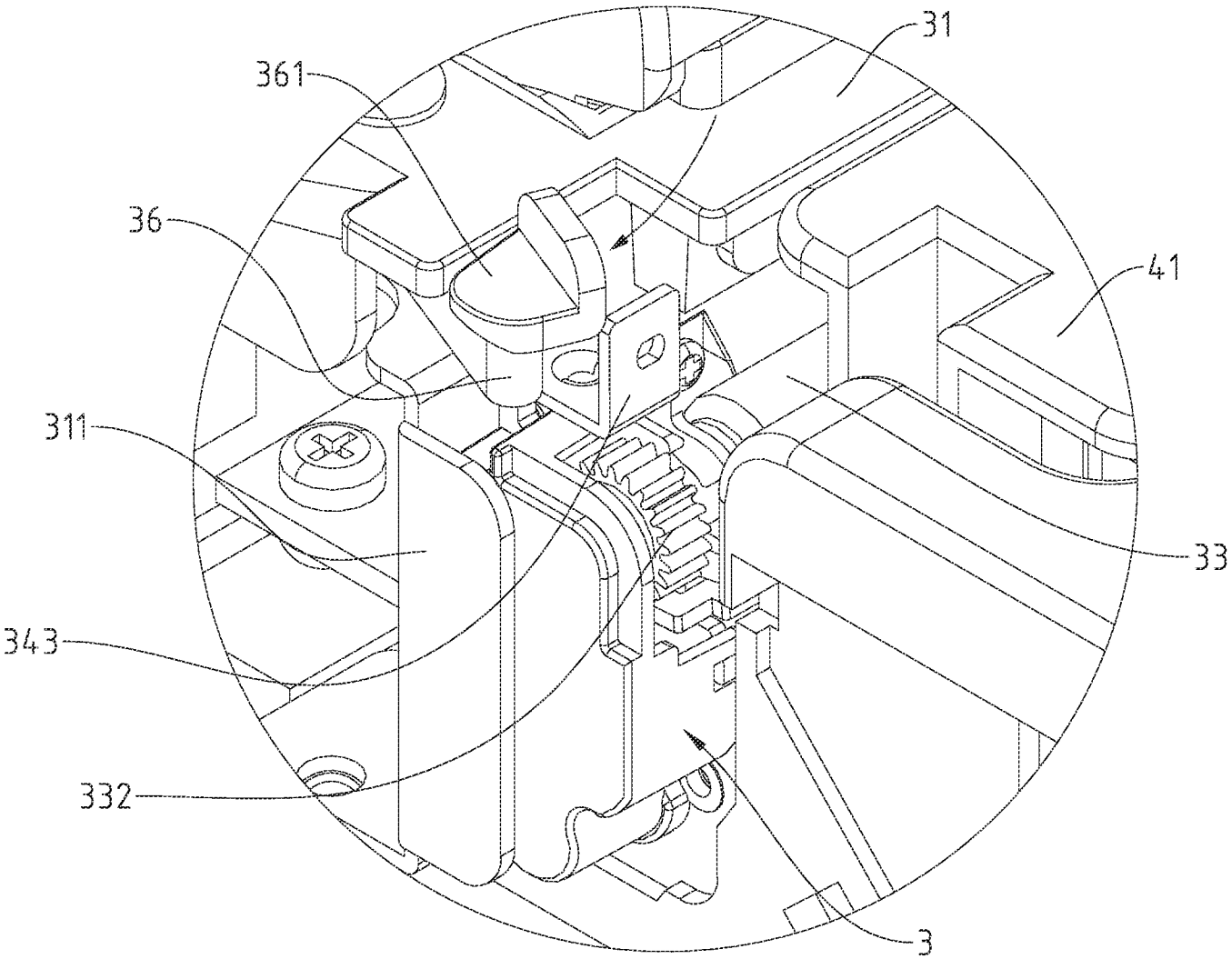
FIG. 12 is a view similar to FIG. 11 with a stopper of the printing device pivoted outward.
Figure 13:
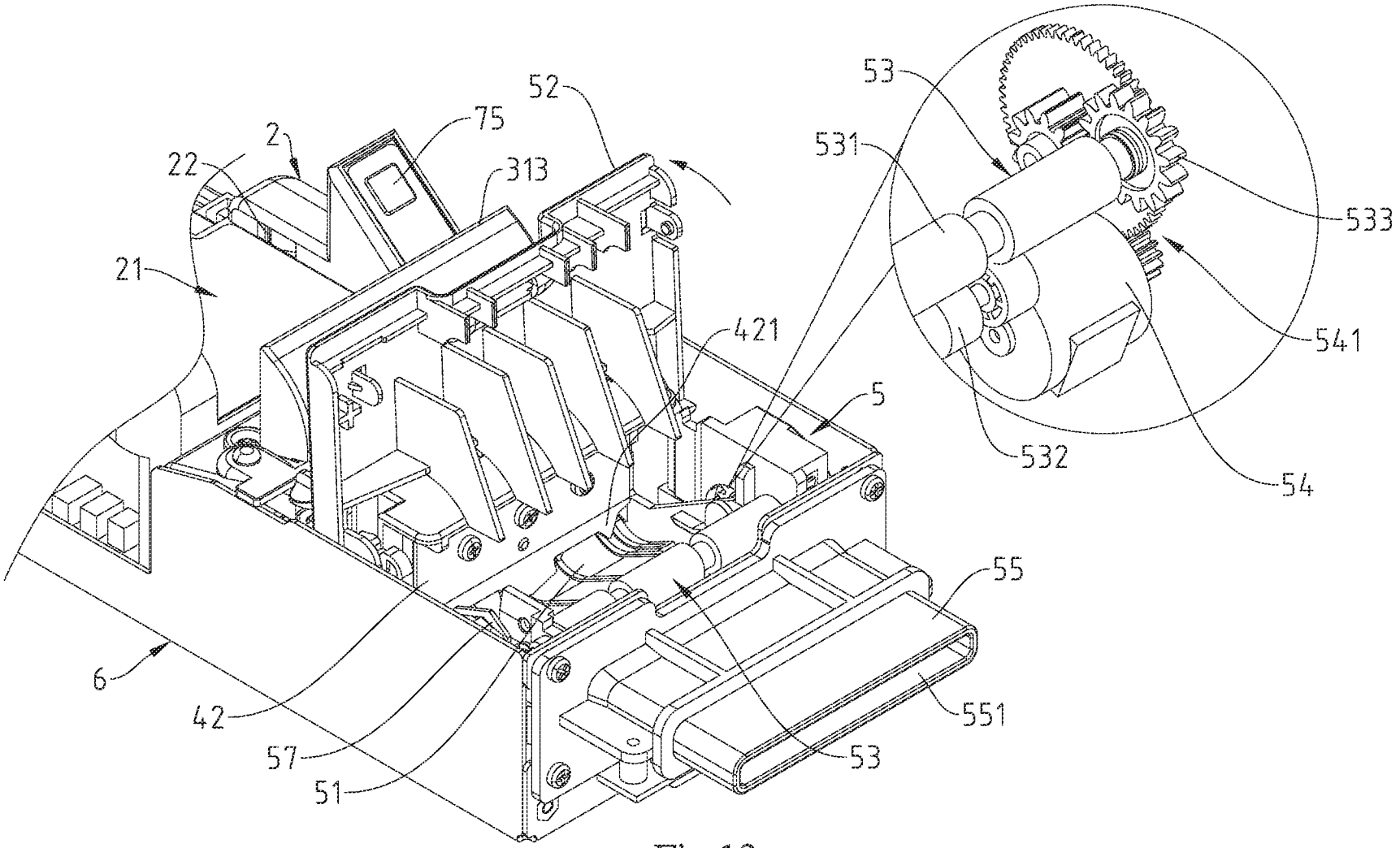
FIG. 13 is a partial, perspective view of the barcode printer of the embodiment according to the present invention with a top cover of a paper output device opened upwards.

The printer 32 can be of a hot-press printing type. The printer 32 is disposed in a seat 311 of the printing seat 31 and extends in a transverse direction, as shown in FIGS. 5, 9, and 10. The paper delivering roller 33 presses against the printer 32. Each of the printing seat 31 and the paper cutting seat 41 includes an intermediate portion having a recess 316, 411 (see FIG. 1) facing the paper delivering roller 33. The paper delivering roller 33 has two shaft ends 331 rotatably mounted to two supporting portions 317 of the seat 311 and two holding arms 341 on two sides of the pivotal holding member 34. The two holding arms 341 are rotatably mounted to the seat 311 of the printing seat 31. A plurality of springs 344 is connected between the pivotal holding member 34 and the printer 32, such that the two holding arms 341 are biased downwardly to be securely coupled to the two shaft ends 331 of the paper delivering roller 33. One of the two holding arms 341 and the holding portion 342 has a pressing portion 343 configured to be manually pressed to pivot the two holding arms 341 and the holding portion 342 upward to release the paper delivering roller 33. The printing seat 31 includes a stopper 36 configured to be pivotable to a position in which a stop portion 361 of the stopper 36 stops the pressing portion 343 of the one of the two holding arms 341.

Figure 17:
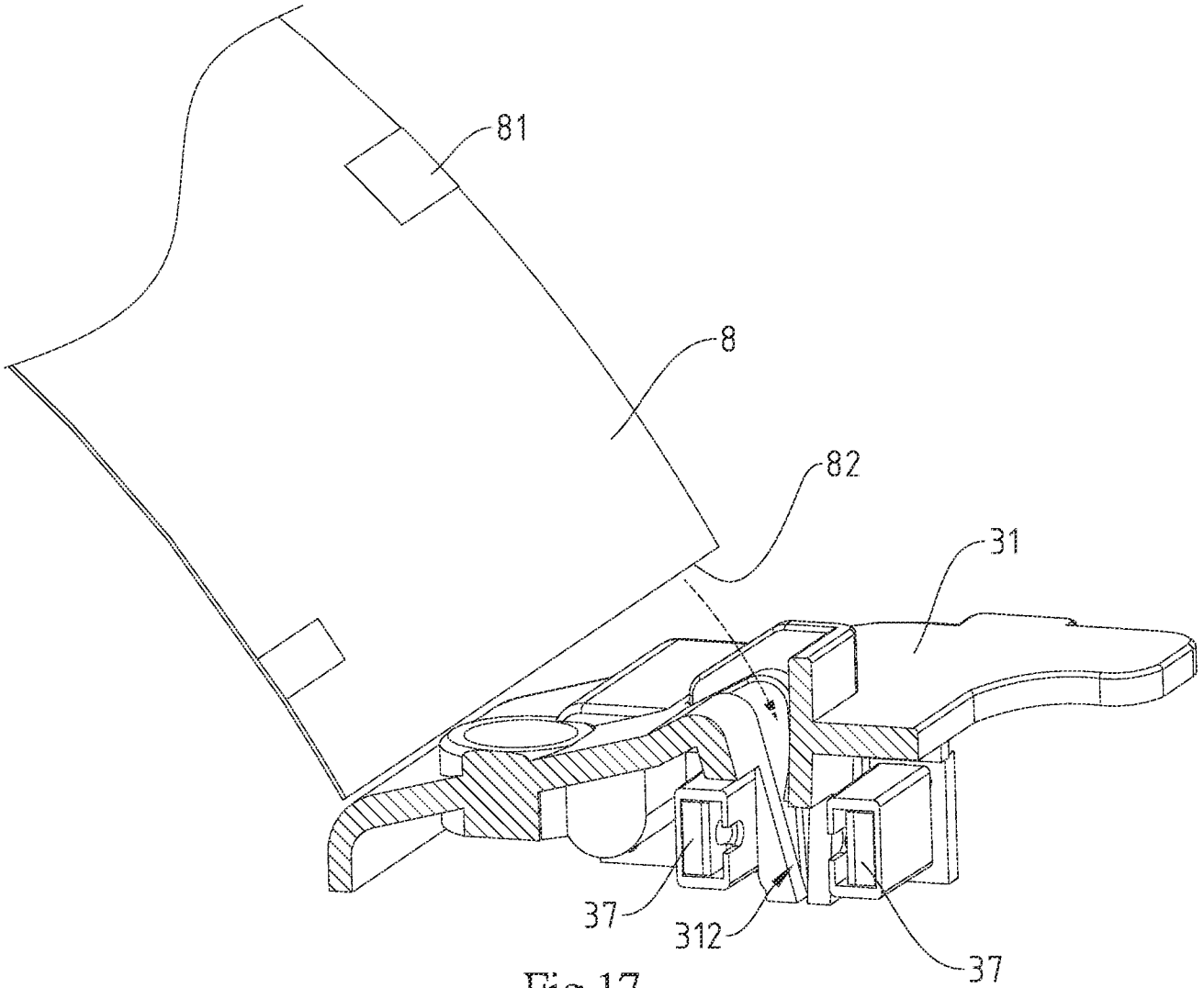
FIG. 17 is a diagrammatic cross sectional view illustrating delivery and detection of the printing paper by the printing device.

The paper delivering motor 35 is located below the printer 32 and has a shaft configured to drive the paper delivering roller 33 and a gear 332 to rotate via transmission by a gear unit 351. The first detector 37 (see FIGS. 5, 6, and 17) is disposed on the seat 311 and is configured to detect the mark 81 on the respective printing paper 8.

Figure 6:
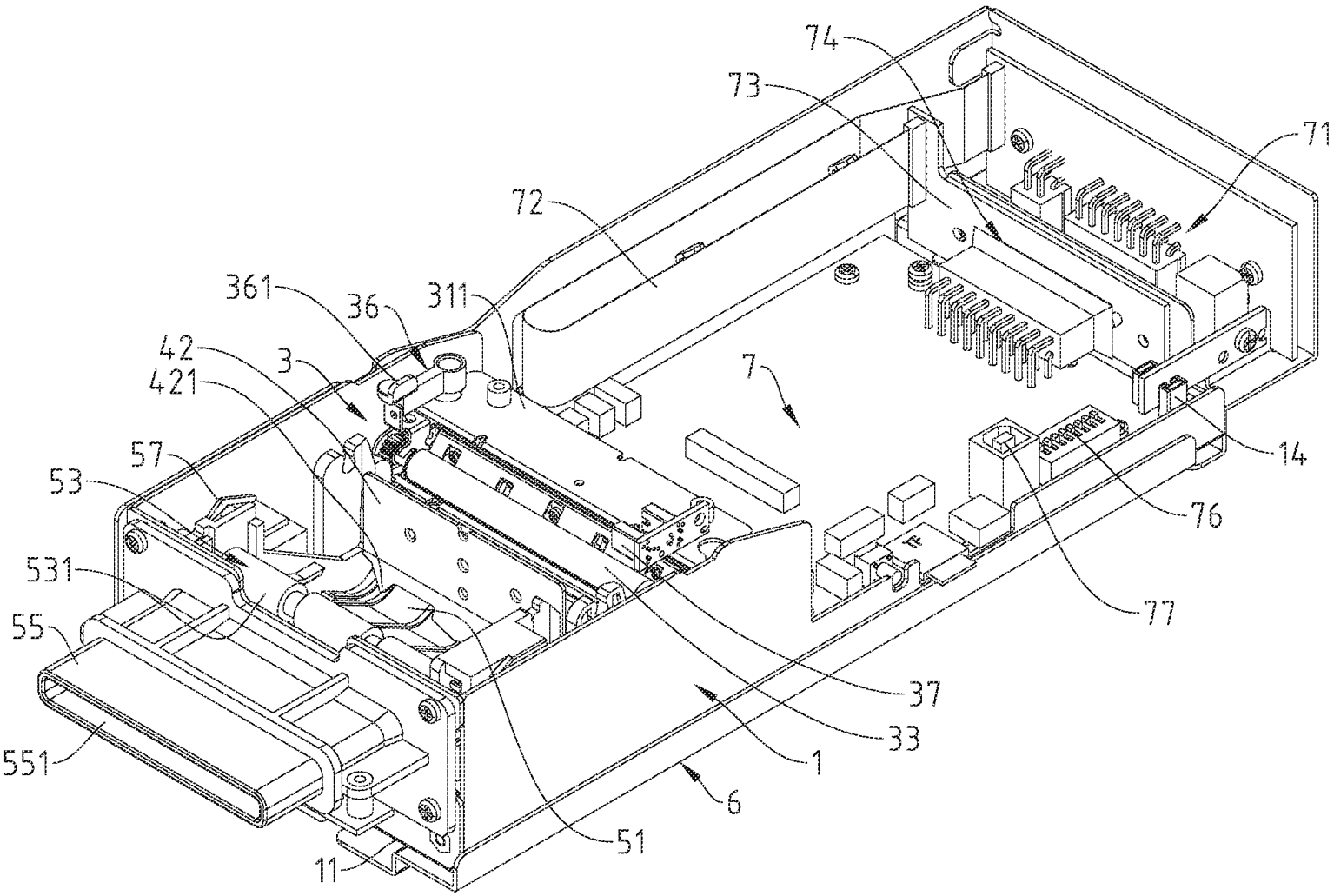
FIG. 6 is a front, top, right perspective view of the barcode printer of the embodiment according to the present invention, illustrating an interior of the barcode printer.

The paper cutting device 4 includes a paper cutting seat 41 and a cutter 42 (see FIGS. 4-6). The cutter 42 is disposed in the paper cutting seat 41. Furthermore, the cutter 42 has a cutting blade 421 facing downwards.

The paper output device 5 includes a paper output seat 51, a top cover 52, a paper output roller unit 53, a paper output motor 54, and a paper output connecting seat 55, as shown in FIGS. 1, 5, 6, and 13. The paper output seat 51 has a rear section extending below the cutter 42 to a position adjacent to the printer 32. The top cover 52 is openably disposed on top of the paper output seat 51. A micro switch 57 is disposed on the paper output seat 51 and is configured to detect an open state or a closed state of the top cover 52. The paper output roller unit 53 is disposed on a front section of the paper output seat 51 and extends in the transverse direction. The paper output roller unit 53 includes two paper output rollers 531 and 532 disposed in parallel and pressing against each other. The paper output motor 54 is configured to drive the paper output roller 531 and a gear 533 to rotate via transmission by a gear unit 541 (see FIG. 13). The paper output connecting seat 55 and a front end of the paper output seat 51 together form a paper outlet 551. A second detector 56 is disposed in the paper output seat 51 and is configured to detect output of the cut printing paper 8 (see FIG. 5).

Figure 7:
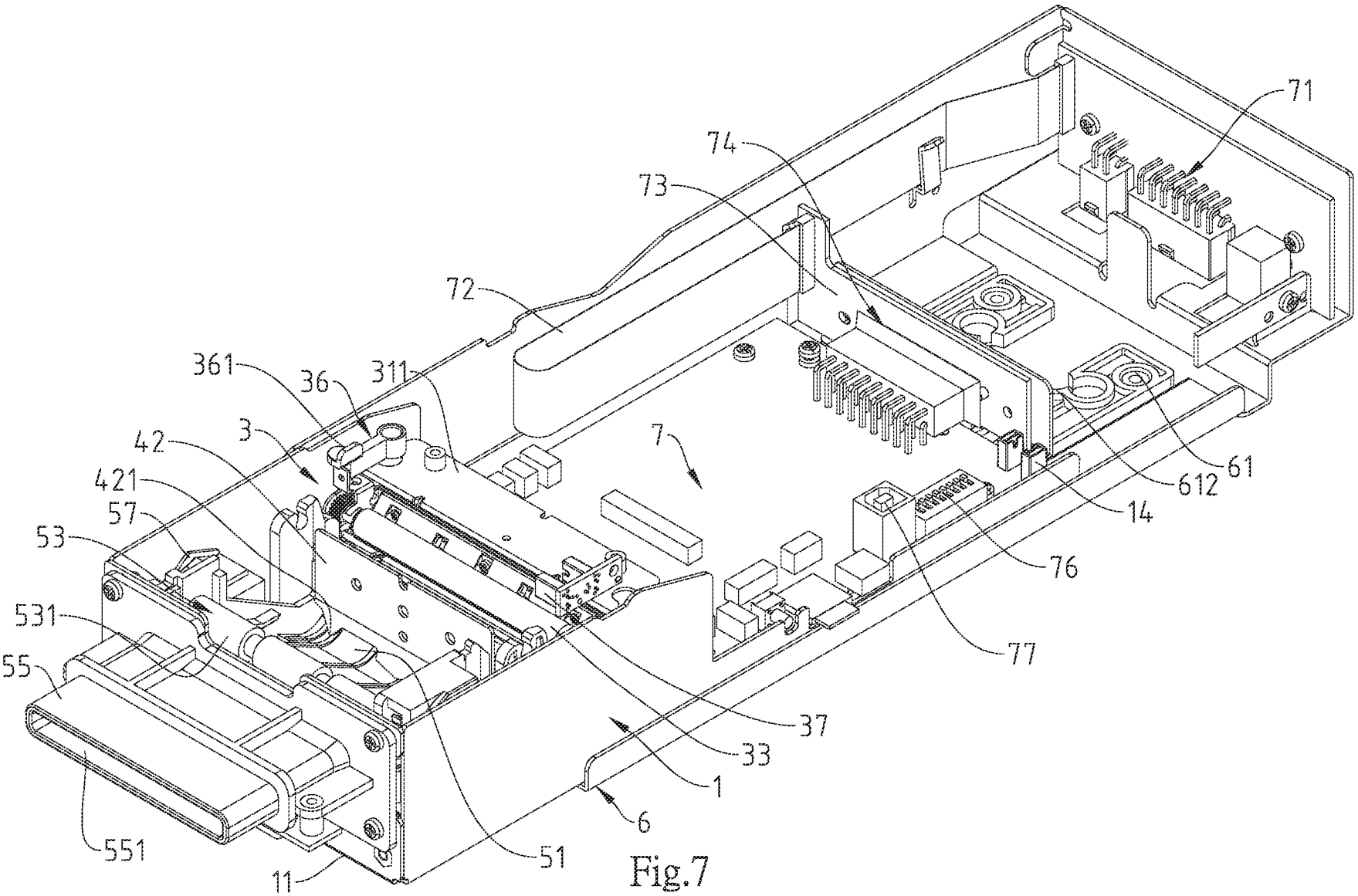
FIG. 7 is a perspective view similar to FIG. 6 with the barcode printer moved forward relative to a fixing seat.
Figure 8:
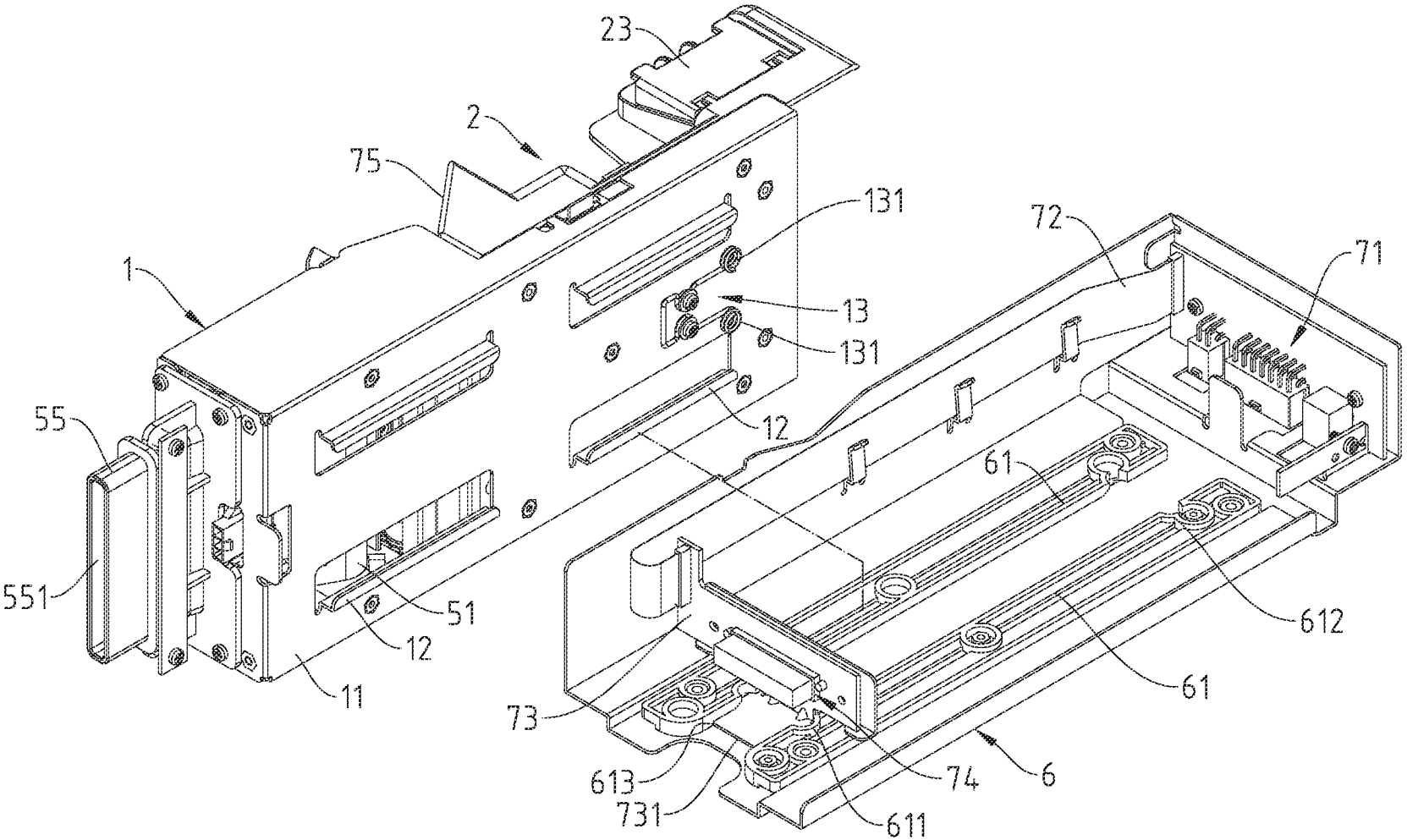
FIG. 8 is an exploded, perspective view of the barcode printer and the fixing seat.

As shown in FIGS. 6-8, the fixing seat 6 includes two guiding tracks 61 on two sides thereof to cooperate with the two side tracks 12 at the bottom portion of the frame 1. Furthermore, a third detector 14 is disposed on the frame 1 and is configured to detect forward displacement of the frame 1 relative the fixing seat 6 to a position outside of the fixing seat 6. Each of the two guiding tracks 61 of the fixing seat 6 has two positioning grooves 611 and 612 on a front portion and a rear portion thereof, respectively. The positioning grooves 611 and 612 cooperate with the two elastic positioning portions 131 of the positioning member 13 to provide relative positioning of the frame 1.

As shown in FIGS. 6-8, a flat cable 72 and a connector unit 74 are connected between the circuit module 7 and an inputter 71. A base board 731 of a flat cable base 73 can slide forward to a position stopping stop portions 613 of the guiding tracks 61. The circuit module 7 includes a display 75 for displaying the operation status, a program setter 76, and a connector 77, which are disposed on the paper receiving device 2. Furthermore, the circuit module 7 is electrically connected to the printing device 3 and the paper output device 5.

Figure 18:
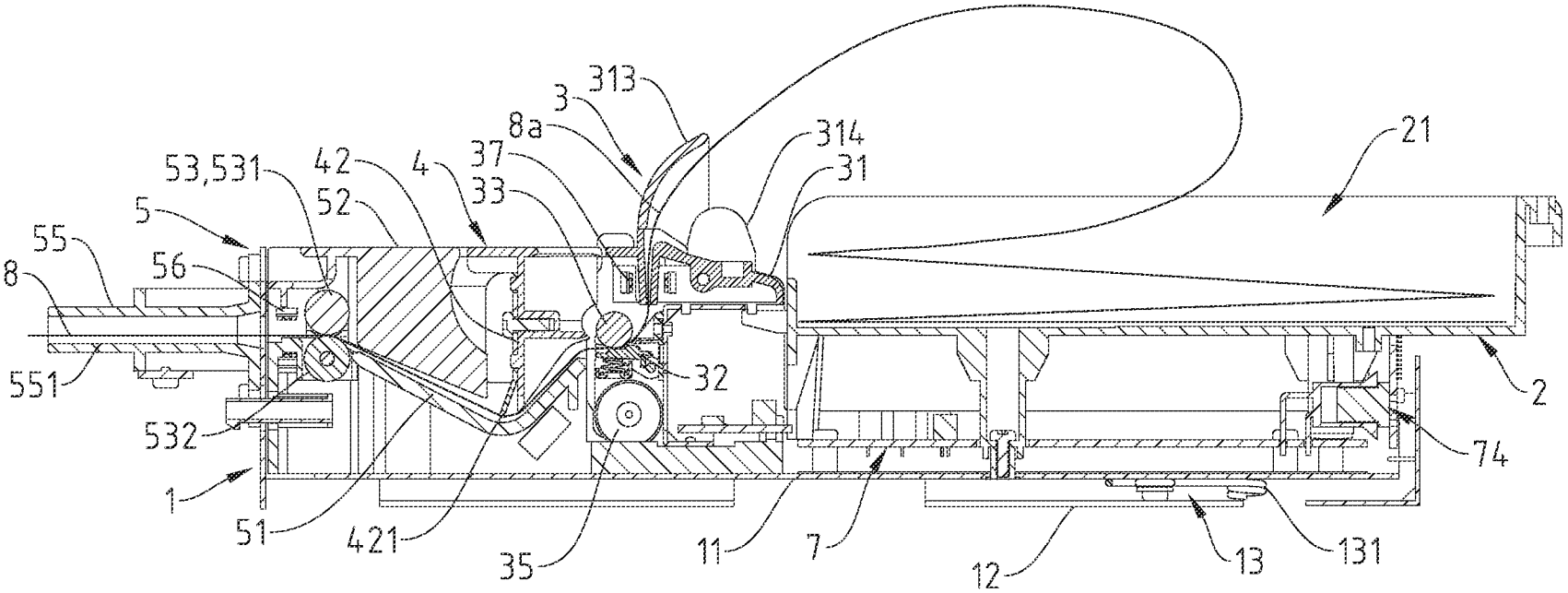
FIG. 18 is a view similar to FIG. 15 with a rear edge of the printing paper moved to a position below a cutter.
Figure 19:
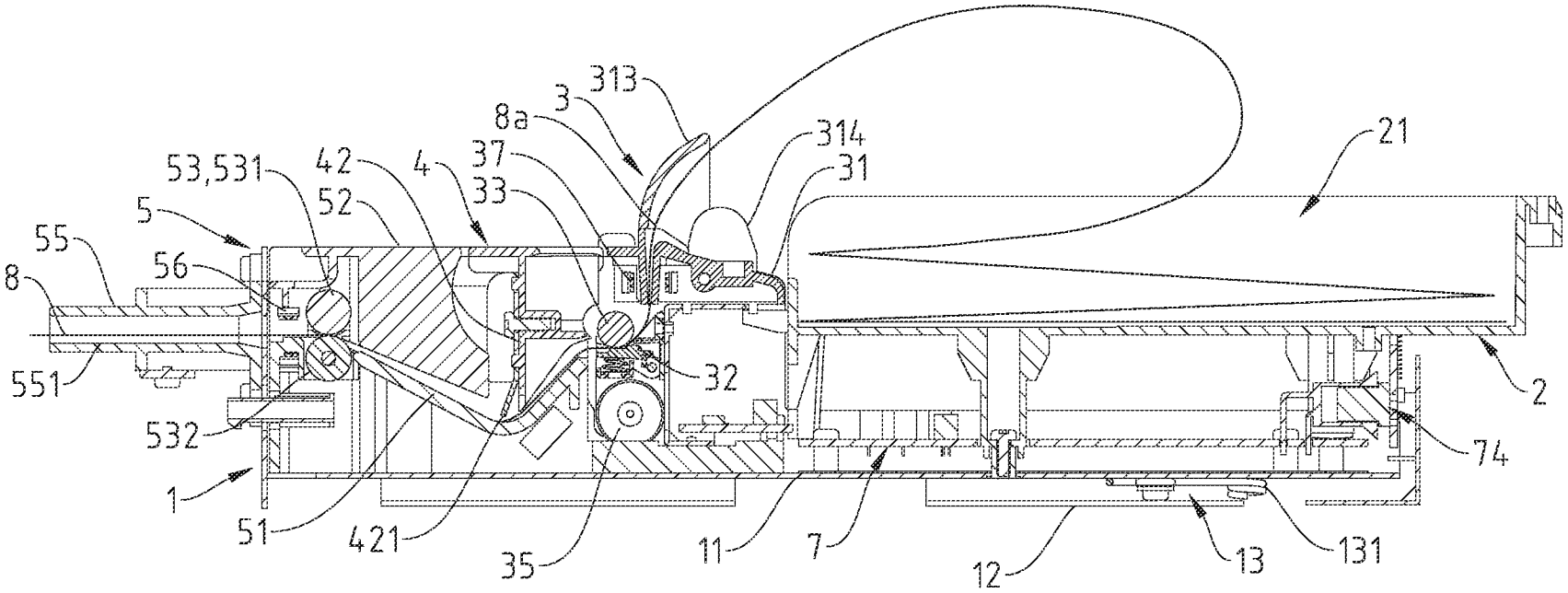
FIG. 19 is a view similar to FIG. 18 with the printing paper moved forward after cutting.

When the barcode printer of the embodiment according to the present invention proceeds with a first printing operation, as shown in FIGS. 14-17, a front edge 82 of an uppermost one of the plurality of printing papers 8 is inserted downward in between the front arcuate guiding board 313 and the rear guiding board 314 of the printing seat 31. The uppermost printing paper 8 enters the paper inlet passage 312. The paper delivering motor 35 drives the paper delivering roller 33 to move the uppermost printing paper 8 forward to pass through a gap between the printer 32 and the paper delivering roller 33. When the mark 81 on the uppermost printing paper 8 is detected by the first detector 37, the printer 32 is activated to print a barcode on a lower face of the uppermost printing paper 8, and the paper delivering roller 33 moves the front edge 82 of the uppermost printing paper 8 to pass below the cutter 42, the paper output seat 51, and a gap between the two paper output rollers 531 and 532. Then, the paper delivering motor 35 is stopped. The paper delivering roller 33 positions the next printing paper 8*a*, such that a rear edge 83 of the uppermost printing paper 8 is stopped at a position below the cutter 42. Next, the paper output motor 54 drives the paper output roller unit 53 to pull the uppermost printing paper 8 forward, moving the rear edge 83 of the uppermost printing paper 8 upward to contact with the cutting blade 421 to cut the rear edge 83 (see FIG. 18), and the paper output roller unit 53 moves the cut printing paper 8 outward (see FIG. 19) so as to be fetched by a user.

Figure 15:
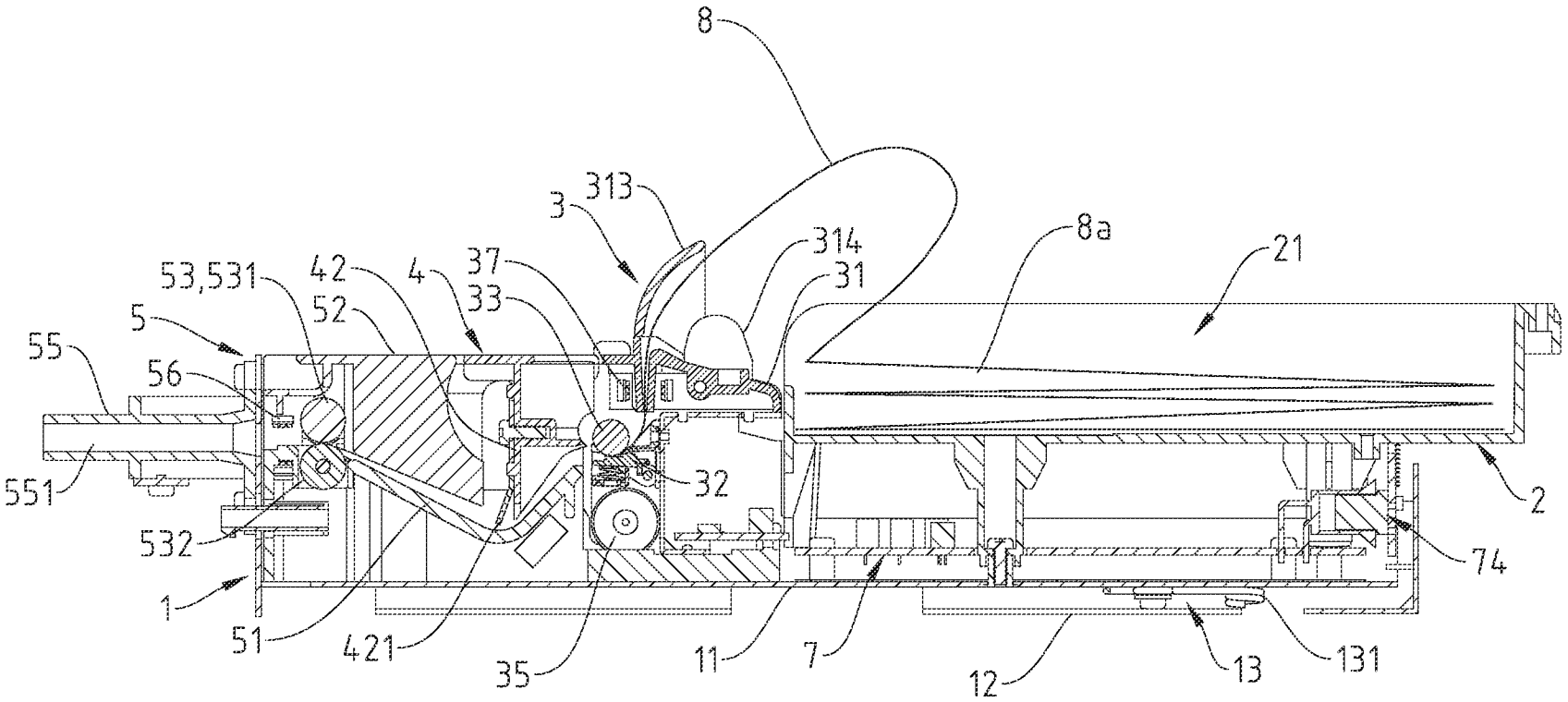
FIG. 15 is a cross sectional view of the barcode printer of the embodiment according to the present invention with a mark on a printing paper reaching a detection position of a first detector.
Figure 16:
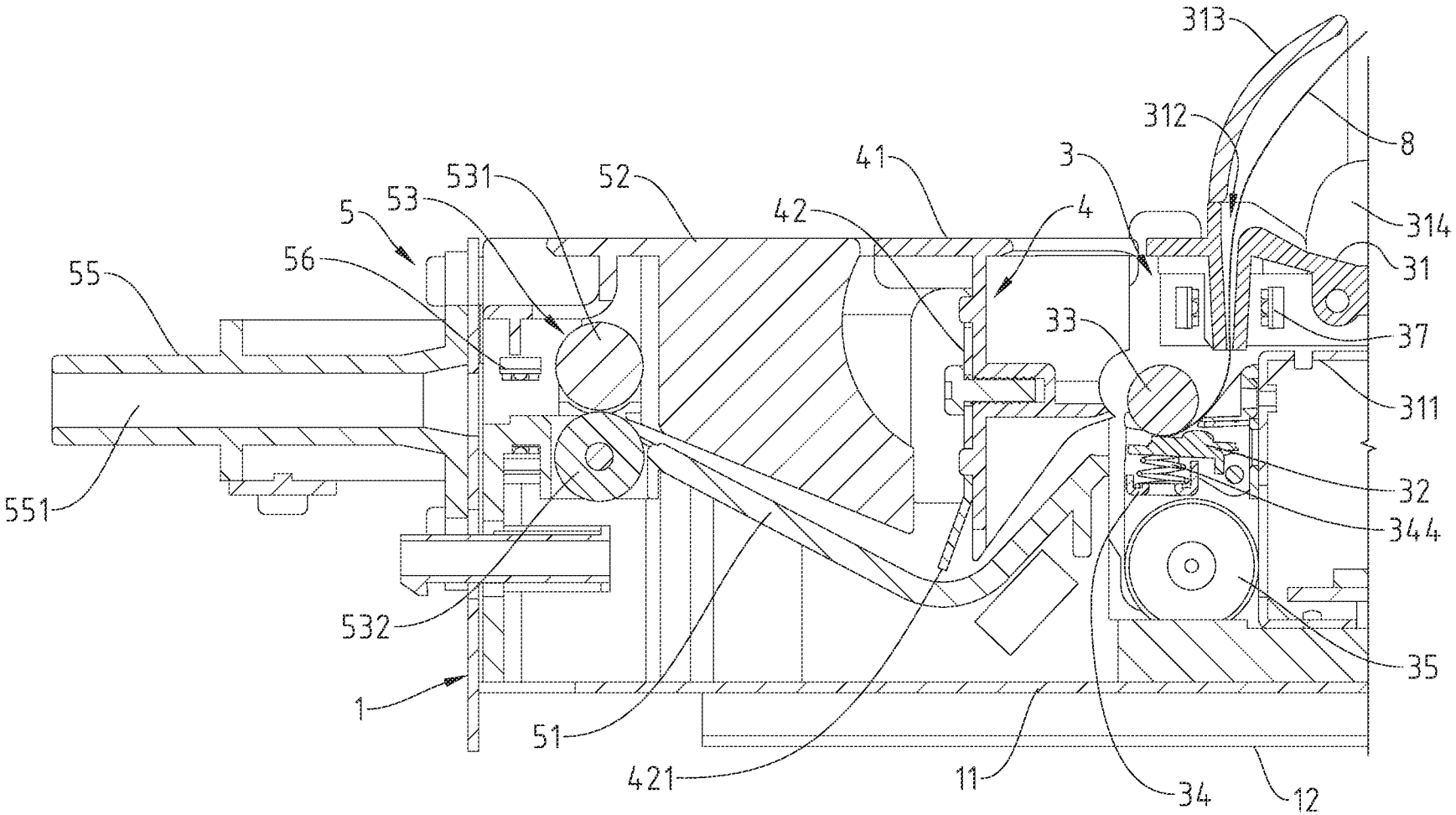
FIG. 16 is an enlarged view of a front section of the barcode printer of FIG. 15.

Then, the printing device 3 controls the paper delivering motor 35 and the paper delivering roller 33 to rotate in a reverse direction, moving the next printing paper 8*a* backward until the mark 81*a* (see FIG. 14) on the printing paper 8*a* stops at the detection position of the first detector 37. Next, a second printing operation is carried out, as shown in FIG. 15. Specifically, the printer 32 is activated to print a barcode on the lower face of the printing paper 8*a*, and the paper delivering roller 33 moves the printing paper 8*a* forward to pass below the cutter 42, the paper output seat 51 and the gap between the two paper output rollers 531 and 532. Next, the above paper cutting procedure and the above paper outputting procedure are conducted.

The barcode printer according to the present invention can control the printing paper 8 to stably proceed with the feeding, printing, cutting, and outputting procedures. In a case that a printing paper 8 is jammed in the printing device 3, an operator can pivot and open the stopper 36 and its stop portion 361. Then, the pressing portion 343 of the pivotal holding member 34 can be pulled rearward, pivoting the two holding arms 341 and the holding portion 342 upward to release the paper delivering roller 33. Thus, the printing paper 8 can be easily pulled rearward to relieve the jam. Next, the operator can extend his or her fingers downwardly into the recesses 316 and 411 of the printing seat 31 and the paper cutting seat 41, thereby returning the paper delivering roller 33. Then, the holding portion 342 of the associated holding arm 341 is pressed downward to couple the two holding arms 341 to the two shaft end portions 331 of the paper delivering roller 33. Next, the stop portion 361 of the stopper 36 is pivoted to a position stopping the pressing portion 343 of the associated holding arm 341. Furthermore, when a printing paper 8 is jammed in the paper output device 5, the operator can open the top cover 52 (see FIG. 13) to relieve the jam.

Although specific embodiments have been illustrated and described, numerous modifications and variations are still possible without departing from the scope of the invention. The scope of the invention is limited by the accompanying claims.

The invention claimed is:

1. A barcode printer comprising a frame, a paper receiving device, a printing device, a cutting device, and a paper output device, with the paper receiving device, the printing device, the cutting device, and the paper output device disposed on the frame, wherein the paper receiving device includes a receiving space having an upwardly facing opening, wherein the receiving space is configured to receive a plurality of printing papers which is interconnected and folded in a zigzag manner, wherein each of the plurality of printing papers has a mark on a face thereof, wherein the printing device includes a printing seat, a printer, a paper delivering roller, a pivotal holding member, a paper feeding motor, and a first detector, wherein the printing seat includes a top portion having a paper inlet passage extending in a transverse direction, wherein a front arcuate guiding board and a rear guiding board extend upward from a front side and a rear side of the paper inlet passage, respectively, wherein the printer is disposed in the printing seat and extends in a transverse direction, wherein the paper delivering roller presses against the printer and has two shaft ends rotatably mounted to two holding arms on two sides of the pivotal holding member, wherein the paper feeding motor is located below the printer and is configured to drive the paper delivering roller via a gear unit, wherein the paper cutting device includes a paper cutting seat and a cutter disposed in the paper cutting seat, wherein the cutter has a cutting blade facing downwards, wherein the paper output device includes a paper output seat, a top cover, a paper output roller unit, a paper output motor, and a paper output connecting seat, wherein the paper output seat has a rear section extending below the cutter to a position adjacent to the printer, wherein the top cover is openably disposed on top of the paper output seat, wherein the paper output roller unit is disposed on a front section of the paper output seat and extends in the transverse direction, wherein the paper output roller unit includes two paper output rollers disposed in parallel and pressing against each other, wherein the paper output motor is configured to drive one of the two paper output rollers, wherein the paper output connecting seat and a front end of the paper output seat together form a paper outlet, wherein a front edge of an uppermost one of the plurality of printing papers is inserted downward in between the front arcuate guiding board and the rear guiding board of the printing seat, the uppermost one of the plurality of printing papers enters the paper inlet passage, wherein the paper delivering motor drives the paper delivering roller to move the uppermost one of the plurality of the printing papers forward to pass through a gap between the printer and the paper delivering roller, wherein when the mark on the uppermost one of the plurality of the printing papers is detected by the first detector, the printer is activated to print a barcode on a lower face of the uppermost one of the plurality of the printing papers, the front edge of the uppermost one of the plurality of the printing papers is moved to pass through the cutter, the paper output seat, and a gap between the two paper output rollers, wherein the paper delivering motor is then stopped to stop a rear edge of the uppermost one of the plurality of the printing papers at a position below the cutter, wherein the paper output motor drives the paper output roller unit to pull the plurality of the printing papers forward, moving the rear edge of the uppermost one of the plurality of the printing papers upward to contact with the cutting blade to cut the rear edge, and wherein the paper output roller unit moves the cut printing paper forward and outward.

2. The barcode printer as claimed in claim 1, wherein the paper receiving device further includes a partitioning board detachably mounted in the receiving space and configured to match with a length of associated printing papers to be received in the receiving space.

3. The barcode printer as claimed in claim 1, wherein a substantially U-shaped fender associated with the receiving space is disposed upright on a peripheral edge of a top portion of the paper receiving device and has a forwardly facing opening, and wherein a sensor is disposed in the receiving space and is configured for detecting whether the plurality of printing papers reaches a low inventory level.

4. The barcode printer as claimed in claim 1, wherein the front arcuate guiding board is higher than the rear guiding board and has two stop boards at two sides thereof.

5. The barcode printer as claimed in claim 1, wherein the two holding arms on the two sides of the pivotal holding member of the printing device are pivotably mounted to the printing seat, wherein a plurality of springs is connected between the pivotal holding member and the printer, such that the two holding arms are biased downwardly to be securely coupled to the two shaft ends of the paper delivering roller, wherein one of the two holding arms has a pressing portion configured to be manually pressed to pivot the two holding arms upward to release the paper delivering roller, and wherein the printing seat includes a stopper configured to be pivotable to a position stopping the pressing portion of the one of the two holding arms.

6. The barcode printer as claimed in claim 1, wherein each of the printing seat and the paper cutting seat includes an intermediate portion having a recess facing the paper delivering roller.

7. The barcode printer as claimed in claim 1, wherein a micro switch is disposed on the paper output seat and is configured to detect an open state or a closed state of the top cover.

8. The barcode printer as claimed in claim 1, wherein a second detector is disposed in the paper output seat and is configured to detect output of the cut printing paper.

9. The barcode printer as claimed in claim 1, wherein a fixing seat is movably connected to a bottom portion of the frame, wherein the fixing seat includes two guiding tracks on two sides thereof, wherein the bottom portion of the frame includes two side tracks associated with the two guiding tracks, and wherein a third detector is disposed on the frame and is configured to detect forward displacement of the frame relative the fixing seat.

10. The barcode printer as claimed in claim 9, wherein a positioning member is disposed on the bottom portion of the frame, wherein the positioning member includes two elastic positioning portions extending on two sides thereof, and wherein each of the two guiding tracks of the fixing seat has two positioning grooves on a front portion and a rear portion thereof, respectively.

* * * * *